US012219985B2

(12) United States Patent
Vincent et al.

(10) Patent No.: US 12,219,985 B2
(45) Date of Patent: Feb. 11, 2025

(54) ORIENTATING A TOBACCO PRODUCT

(71) Applicant: MPRD LTD, Milton Keynes (GB)

(72) Inventors: James Vincent, Milton Keynes (GB); Ali Ramezani, Milton Keynes (GB); Michele Cuppini, Milton Keynes (GB)

(73) Assignee: MPRD LTD, Buckinghamshire (GB)

( * ) Notice: Subject to any disclaimer, the term of this patent is extended or adjusted under 35 U.S.C. 154(b) by 298 days.

(21) Appl. No.: 18/004,217

(22) PCT Filed: Jul. 1, 2021

(86) PCT No.: PCT/GB2021/051674
§ 371 (c)(1),
(2) Date: Jan. 4, 2023

(87) PCT Pub. No.: WO2022/008879
PCT Pub. Date: Jan. 13, 2022

(65) Prior Publication Data

US 2023/0309607 A1 Oct. 5, 2023

(30) Foreign Application Priority Data

Jul. 9, 2020 (GB) ..... 2010555

(51) Int. Cl.
*A24C 5/01* (2020.01)
*A24C 5/32* (2006.01)
*A24C 5/34* (2006.01)

(52) U.S. Cl.
CPC ..... *A24C 5/01* (2020.01); *A24C 5/322* (2013.01); *A24C 5/3412* (2013.01)

(58) Field of Classification Search
CPC ..... A24C 5/34; A24C 5/3412; A24C 5/336; A24C 5/00; A24C 5/01; A24C 5/322
See application file for complete search history.

(56) References Cited

U.S. PATENT DOCUMENTS

2019/0133178 A1* 5/2019 Cieslikowski ..... A24C 5/3412

FOREIGN PATENT DOCUMENTS

| | | | |
|---|---|---|---|
| EP | 0660656 | A1 | 6/1995 |
| EP | 3106863 | A1 | 12/2016 |
| EP | 3206511 | A1 | 8/2017 |
| EP | 3387919 | A1 | 10/2018 |
| EP | 3387979 | A1 | 10/2018 |

(Continued)

OTHER PUBLICATIONS

EP3461352A1 English Machine Translation (Year: 2019).*

(Continued)

*Primary Examiner* — Michael H. Wilson
*Assistant Examiner* — Daniel Edward Vakili
(74) *Attorney, Agent, or Firm* — Cooper Legal Group LLC

(57) ABSTRACT

Apparatus is disclosed for orientating a tobacco product containing a strip component. The apparatus comprises means for producing an image of the tobacco product, means for determining an apparent width of the strip component from the image, means for determining an amount of rotation of the tobacco product based on the apparent width, and means for rotating the tobacco product relative to the imaging means by the determined amount of rotation. This may allow the product to be rotated such that the strip component has a known orientation with respect to the imaging means.

20 Claims, 11 Drawing Sheets

(56) References Cited

FOREIGN PATENT DOCUMENTS

| | | | | |
|---|---|---|---|---|
| EP | 3461352 | A1 * | 4/2019 | ..... A24C 5/01 |
| GB | 2021762 | A | 12/1979 | |
| JP | H1124057 | A | 1/1999 | |
| JP | 2012122754 | A | 6/2012 | |
| JP | 2020030196 | A | 2/2020 | |
| KR | 19980026658 | A | 7/1998 | |
| WO | 2016058786 | A1 | 9/2015 | |
| WO | 2017005705 | A1 | 7/2016 | |
| WO | 2017085242 | A1 | 11/2016 | |
| WO | 2017212358 | A1 | 12/2017 | |
| WO | WO-2020012162 | A1 * | 1/2020 | ..... A24C 5/3412 |

OTHER PUBLICATIONS

Corresponding International Search Report for Patent Application No. PCT/GB2021/051674, mailed Nov. 19, 2021, 9 pages.
Corresponding UKIPO Search Report for application No. GB2010555.7, mailed Dec. 15, 2020, 5 pages.
Corresponding SIPO Search Report for application No. 202180049120.9, dated Nov. 7, 2024, 22 pages.

* cited by examiner

ORIENTATING A TOBACCO PRODUCT

The present invention relates to techniques for orientating a tobacco product containing an internal strip component. The invention has particular, but not exclusive, application with heated tobacco products containing a susceptor.

Various types of heated tobacco products have started to appear on the marketplace. These products are characterised by the ability to heat a tobacco column without combustion or smouldering to release an aerosol containing nicotine and flavours. One particular type of heated tobacco product involves the use of a metal plate or susceptor contained within the tobacco column which is inductively heated by surrounding electronics. Such products avoid the need for an insertable blade that could be broken and the need to clean the heating element. An example of such a product is disclosed in WO 2017/085242, the subject matter of which is incorporated herein by reference.

During the production of tobacco products, it is necessary to ensure that the quality of the product is maintained. In the case of articles with an internal susceptor, the positioning and accuracy of formation of the susceptor is a key quality measure in the production process. Measurements are therefore made as part of a quality assurance and quality control process. For example, WO 2020/012162, the subject matter of which is incorporated herein by reference, discloses apparatus for analysing a rod-shaped smoking article which produces x-ray images of the product under test. This can allow defects in internal components to be detected.

One challenge facing the quality assurance/quality control professional is that the measurement required may be orientation specific. For example, a measurement may need to be made where an internal strip component such as a susceptor is at right angles to a detector or in line with a detector. An example of such a requirement is the transmission imaging of a product to measure the position of the susceptor relative to the circumferential envelope paper and the circular ends of the tobacco segment. To measure a large number of articles with a precise orientation with respect to a sensor can be a time consuming, labour intensive task that is prone to error.

Co-pending United Kingdom patent application number 1917430.9, the subject matter of which is incorporated herein by reference, discloses a technique for orientating a heated tobacco product containing a susceptor such that the product is in a known orientation for subsequent testing. The technique involves the use of a magnetic system to rotate the product. It has been found that such a technique can be effective in pre-aligning the product prior to testing. However, this approach has the disadvantage that the magnetic system requires space to operate and adds cost and complexity to the construction of the testing apparatus. Additionally, it will only work with ferromagnetic susceptors and will not work with alternative materials that may be deployed.

It would therefore be desirable to provide a technique for orientating a tobacco product such that an internal strip component is at a known angle, which minimises space, cost and complexity, and which will work with a variety of different materials.

According to one aspect of the invention there is provided apparatus for orientating a tobacco product containing a strip component, the apparatus comprising:

means for producing an image of the tobacco product;

means for determining an apparent width of the strip component from the image;

means for determining an amount of rotation based on the apparent width; and means for rotating the product relative to the imaging means by the determined amount of rotation.

The present invention may provide the advantage that, by determining an amount of rotation based on the apparent width of the strip component in an image of the tobacco product, it may be possible to rotate the product such that the strip component has a known orientation with respect to the imaging means. This may be achieved using imaging means which may also be used for testing of the product, thereby minimising any additional space, cost and complexity. For example, the orientation process may avoid the need for a magnetic rotation system and may be used with non-ferromagnetic strip components.

By "strip component" it is preferably meant a component which has a width which is greater than its thickness, preferably significantly greater. For example, the width may be at least 5, 10, 15 or 20 times larger than the thickness.

Preferably the strip component is an internal component. For example, the strip component may be a susceptor. The susceptor may be located inside a tobacco column and may be arranged to heat the tobacco through inductive heating. The tobacco product may be for use with an inductive heating device for inductively heating the strip component.

Preferably the amount of rotation is that which would be expected to bring the strip component into a known orientation with respect to a field of view of the imaging means. For example, the amount of rotation may be that which would be expected to align the strip component with or bring it perpendicular to a field of view of the imaging means, or to bring it to any other angle. This can allow, for example, side on imaging of the strip component and/or frontal imaging of a strip component, which may facilitate the detection of defects in the strip component.

Preferably the amount of rotation is calculated from the apparent width and a notional width of the strip component. The notional width of the strip component may be a predetermined value, which may be stored in memory. The notional width may be based on known or expected properties of the strip component, for example, a known width of a strip of material from which the strip component is made. Thus, the inherent size and shape of the strip component may be used to calculate the amount of rotation.

In one embodiment, the amount of rotation is calculated from the apparent width and the notional width using an inverse trigonometric function. For example, if it is desired to rotate the sample such that the strip component is aligned with the field of view of the imaging means, then the amount of rotation may be calculated from the equation $$\theta = \cos^{-1}\frac{W1}{W}$$

where θ is the amount of rotation, W1 is the apparent width and W is the notional width of the strip component. On the other hand, if it is desired to rotate the sample such that the strip component is perpendicular to the field of view of the imaging means, then the amount of rotation may be calculated from the equation $$\theta = \sin^{-1}\frac{W1}{W}.$$

Alternatively, an inverse trigonometric function may be used to estimate the current angle of the strip component relative to the field of view, and the amount of rotation required to bring the strip component to another desired angle may be calculated by adding to or subtracting from the estimated current value.

As an alternative to an inverse trigonometric function, the amount of rotation could be determined using a look-up table which maps apparent width to amount of rotation. Such a look-up table may contain predetermined values, which may have been obtained, for example, through empirical measurements and/or trigonometric calculations.

In some embodiments, the strip component may have rotational symmetry. In this case, the same apparent width may be produced if the strip component were orientated either clockwise or anticlockwise by the same angle. Thus, the alignment process may need to take into account the fact that the rotation should be either clockwise or anticlockwise.

In a preferred embodiment, the imaging means is arranged to produce a second image of the product after the product has been rotated. In this case, the means for determining an apparent width may be arranged to determine a second apparent width of the strip component from the second image. The apparatus may then be arranged to compare the second apparent width to the first apparent width, and to rotate the sample in the opposite direction to that in which the sample was originally rotated in dependence on a result of the comparison. For example, the apparatus may be arranged to rotate the sample in the opposite direction if the result of the comparison indicates that the apparent width has changed in a way which is opposite to that which would be expected if the original rotation had been in the correct direction, so as to bring the strip component into a desired orientation with respect to the field of view of the imaging means. This may allow the apparatus to compensate for the fact that the original rotation may have been in the incorrect direction.

For example, if it is desired to rotate the sample such that the strip component is aligned with the field of view of the imaging means, then the apparatus may be arranged to determine whether the second apparent width is greater than the first apparent width, and to rotate the sample in the opposite direction to that in which the sample was originally rotated if the second apparent width is greater than the first apparent width. On the other hand, if it is desired to rotate the sample such that the strip component is perpendicular to the field of view of the imaging means, then the apparatus may be arranged to determine whether the second apparent width is less than the first apparent width, and to rotate the sample in the opposite direction to that in which the sample was originally rotated if the second apparent width is less than the first apparent width.

In one embodiment, the sample is rotated in the opposite direction to that in which it was originally rotated by twice the amount of the original rotation. In another embodiment, a second amount of rotation is determined based on the second apparent width, and the sample is rotated in the opposite direction by the second amount of rotation. The second amount of rotation is preferably that which would be expected to bring the strip component into the desired orientation with respect to the field of view of the imaging means, after the original rotation. Alternatively, some combination of these two arrangements could be used. For example, a (possibly weighted) average of the first amount of rotation and the second amount of rotation could be used.

As an alternative, if the strip component contains features, such as markings, indentations or bends, which are non-symmetrical and which are visible in the image, or if the strip component itself is non-symmetrical, then the apparatus may be arranged to identify such features in the image, and to determine a direction of rotation on the basis of their location in the image.

In a preferred embodiment, prior to determining the amount of rotation and/or rotating the product, a check may be carried out to determine whether the product is already in the desired orientation. Thus, the apparatus may comprise means for comparing the apparent width with a notional dimension of the strip component (possibly allowing for some margin of error), and the apparatus may be arranged to perform the rotation in dependence on a result of the comparison.

For example, if the apparent width has a predetermined relationship with the notional dimension, then it may be assumed that the product is in the correct orientation. Thus, the orientation process may be terminated if the apparent width has a predetermined relationship with the notional dimension.

The notional dimension may be equivalent to a dimension which the apparent width would be expected to have if it was in the correct orientation. For example, the notional dimension may be one of notional thickness and notional width. The notional dimension may be a predetermined value and/or may be stored in memory. The predetermined relationship may be one of: less than or equal to; and greater than or equal to (possibly allowing for some margin of error).

For example, if it is desired to rotate the sample such that the strip component is aligned with the field of view of the imaging means, then the apparent width may be compared with the notional thickness of the strip component. In this case, if the apparent width is less than or equal to the notional thickness, then it may be assumed that the strip component is already aligned with the field of view, in which case the orientation process may be terminated. On the other hand, if it is desired to rotate the sample such that the strip component is perpendicular to the field of view, then the apparent width may be compared with the notional width of the strip component. In this case, the orientation process may be terminated if the apparent width is greater than or equal to the notional width (within a desired margin of error).

The above steps may also be carried out after the rotation has been performed and a second (or subsequent) image taken.

If desired, after having rotated the sample using any of the techniques described above, further fine tuning of the amount of rotation may be performed. For example, a succession of small incremental rotations could be performed, and the apparent width compared to the notional width after each rotation, until the apparent width has a predetermined relationship with the notional dimension within the required margin of error. The direction of rotation may be determined from the previous results.

In one embodiment the apparatus is arranged such that, after having rotated the sample, the sample is then rotated through 90° and a further image taken. In this case, the apparent width of the strip component in the further image may be determined, and the thus determined width may be used in a subsequent calculation of the amount of rotation. For example, where the original rotation is such as to align the strip component with the field of view of the imaging means, the apparent width of the strip component in the further image may be used to provide an updated value of the notional width. Where the original rotation is such as to bring the strip component perpendicular with the field of view of the imaging means, the apparent width of the strip component in the further image may be used to provide an updated value of the notional thickness.

Alternatively, the imaging means may be arranged to take two (or more) images of the sample, the two images corresponding, for example, to a front and side view of the sample.

In any of the above arrangements, rotating the product relative to the imaging means may be achieved by rotating the product, or rotating the imaging means, or both. However, in a preferred embodiment, rotation is of the tobacco product. For example, the tobacco product may be rod-shaped and the rotation may be of the tobacco product about its longitudinal axis.

The means for rotating the product may comprise means for holding the product as it is being rotated. The holding means is preferably configured to releasably hold the product. For example, the holding means may comprise a mechanical chuck, a vacuum chuck, grippers, a flexible medium such as an expandable sleeve or latex, an expanding iris, or any other suitable holding mechanism.

The means for rotating the product may comprise an actuator, such as a motor, for producing physical rotation of the product. The actuator is preferably configured to cause a holding means for holding the product to rotate.

The means for rotating the product may comprise a positional encoder. The apparatus may use an output of the positional encoder to ensure that the product has been rotated by the correct amount.

Preferably the imaging means is arranged for transmission imaging of the product. This may allow the imaging means to produce an image of the product, which image includes an internal component such as a susceptor.

For example, the imaging means may be arranged to produce an x-ray image of the sample. Thus, the apparatus may comprise an x-ray imaging system arranged to produce an x-ray image of the tobacco product.

In any of the above arrangements, the apparatus may comprise processing means (such as a processor running the appropriate software) for determining the apparent width and/or for determining the amount of rotation. Any of the other functions described above may also be carried out by or under control of the processing means.

In a preferred embodiment, the apparatus is arranged to test the tobacco product after it has been orientated. Thus, the apparatus may be a testing apparatus for testing the tobacco product. This may allow the orientation of the tobacco product to be carried out by an apparatus which is also used to test the product. This may avoid the need to provide a separate piece of equipment such as a magnetic system to carry out the orientation, which in turn may help to minimise size, cost and complexity of the apparatus.

The testing apparatus may be arranged to detect a defect in the tobacco product, such as a defect in the strip component. The testing may be used, for example, as part of a quality screen process testing against pass and fail criteria.

For example, the apparatus may be arranged to produce an image of the sample with the strip component side-on (parallel) to the field of view of the imaging means, and to analyse the image to detect a defect. The defect may be, for example, one or more of: a misshaped component; a misplaced component; a mis-sized component; a missing component; a curved component; a folded-over component; an off-centre component; and a twisted component; or any other defect.

According to another aspect of the invention there is provided apparatus arranged to orientate a tobacco product containing a strip component, the apparatus comprising:

- an x-ray imaging system arranged to produce an x-ray image of the tobacco product;
- a processor arranged to determine an apparent width of the strip component from the image, and to determine an amount of rotation based on the apparent width; and
- a rotating mechanism arranged to rotate the product relative to the imaging system by the determined amount of rotation.

Corresponding methods may also be provided. Thus, according to another aspect of the invention, there is provided a method of orientating a tobacco product containing a strip component, the method comprising:

- producing an image of the tobacco product;
- determining an apparent width of the strip component from the image;
- determining an amount of rotation based on the apparent width; and
- rotating the product relative to the imaging means by the determined amount of rotation.

Any of the above features may be provided together in any appropriate combination. Features of one aspect of the invention may be provided with any other aspect. Apparatus features may be provided with method aspects and vice versa.

Preferred features of the present invention will now be described, purely by way of example, with reference to the accompanying drawings, in which:

FIG. 1 shows parts of a heated tobacco product with a susceptor;

FIGS. 2(A) to 2(C) illustrate different types of deformation in a susceptor;

Figure 10:
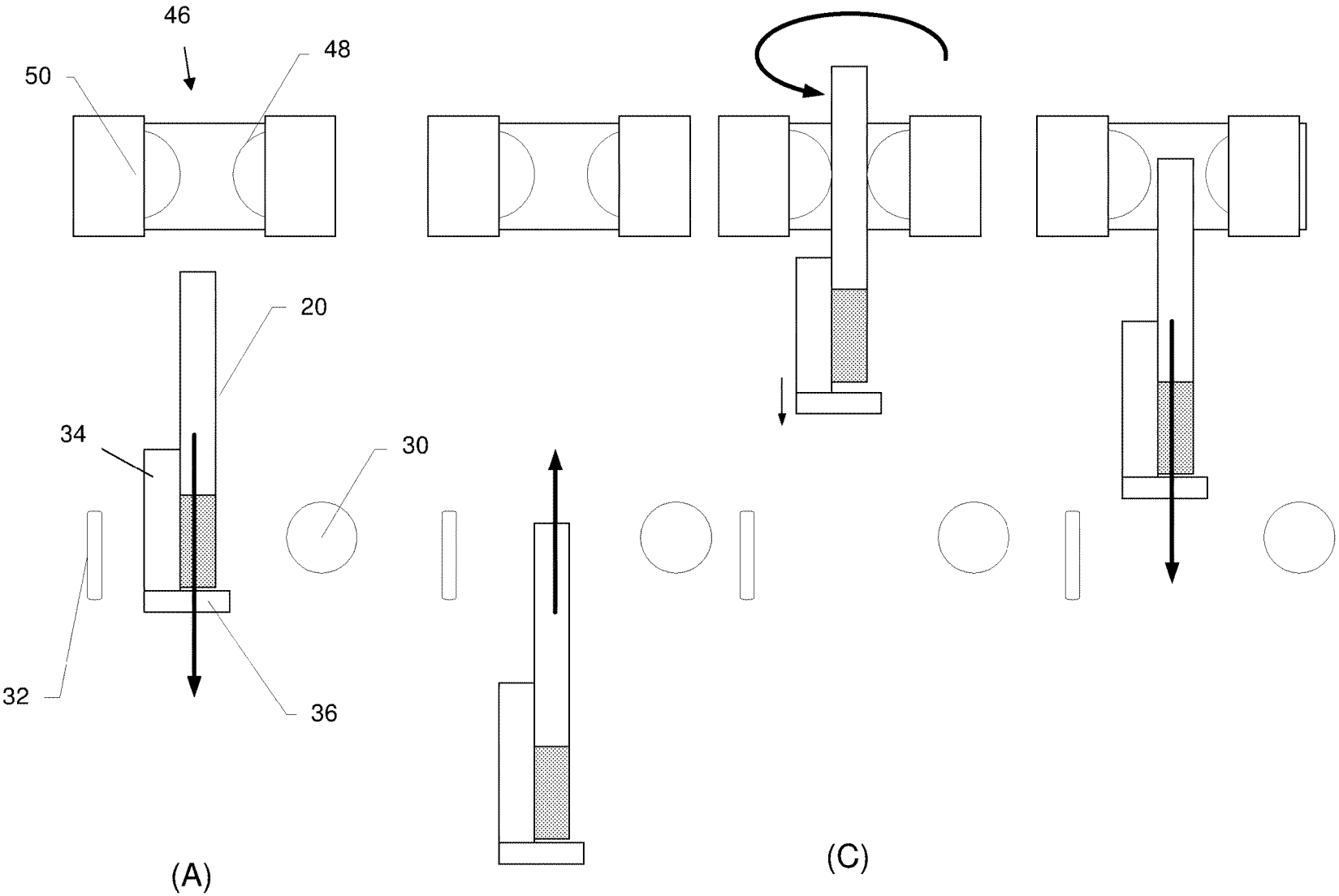
Figure 11:
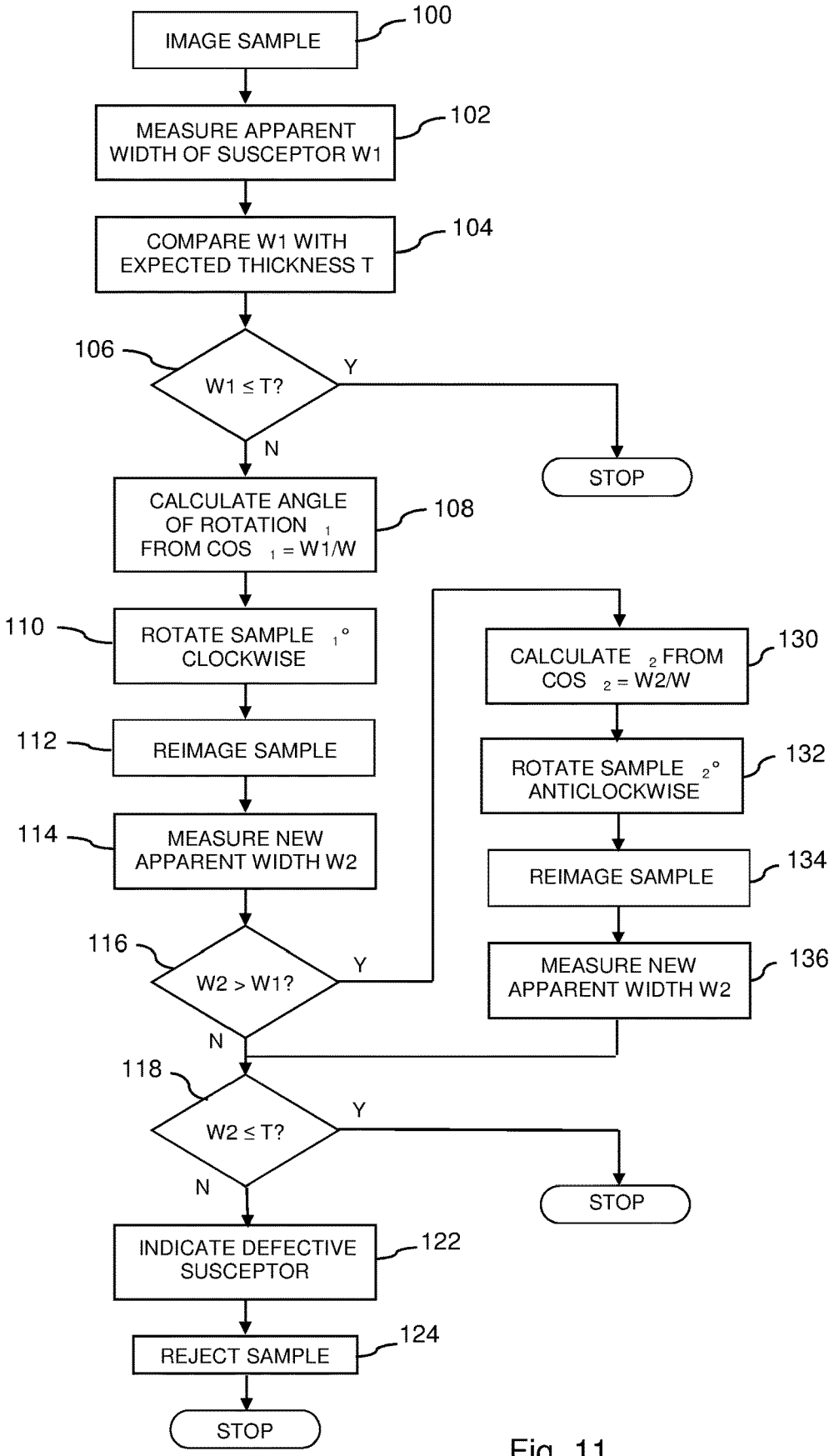

FIGS. 10(A) to 10(D) illustrate the process of imaging and rotating the sample in one embodiment; and FIG. 11 shows steps taken by the orientation system in another embodiment.

The tobacco industry has recently produced several innovations in the field of heated tobacco products. One particular innovation involves the use of a metal plate or susceptor within the tobacco column.

Figure 1:
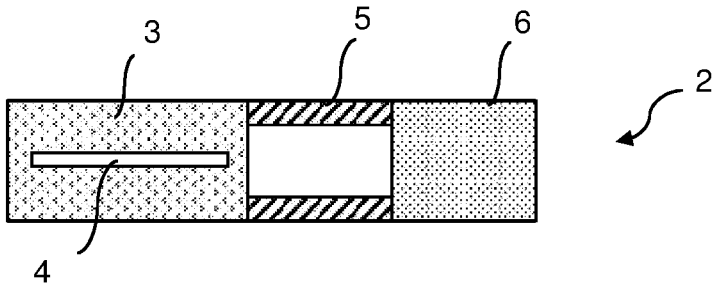

FIG. 1 shows parts of an example heated tobacco product with a susceptor. Referring to FIG. 1, the heated tobacco product 2 comprises a tobacco column 3 with a metallic susceptor blade 4. The susceptor blade 4 is made from a magnetically permeable and electrically conductive metallic material. The heated tobacco product 2 includes a cooling/condensation element 5 and a particulate filter 6. The cooling/condensation element 5 is in the form of a hollow cellulose acetate tube. The heated tobacco product 2 may be wrapped in paper in a similar way to a conventional cigarette to form a rod-shaped article. Various other components may be present in the product as well as or instead of those shown.

The heated tobacco product of FIG. 1 is designed to be inserted into a heating device with an inductive heating source. The inductive heating source produces an alternating magnetic field, which induces an alternating magnetic field in the susceptor 4. This induced alternating magnetic field generates heat in the susceptor. At least some of the heat generated in the susceptor 4 is transferred to the tobacco column 3 to release an aerosol containing nicotine and flavours. This aerosol passed through the cooling element 5 and filter 6 and is inhaled by the user.

A process by which a heated tobacco product such as that shown in FIG. 1 may be manufactured is described in, for example, WO 2017/005705, the subject matter of which is incorporated herein by reference.

During manufacture of a tobacco product, it is important to monitor and control the process, in order to ensure that defects do not occur in the final product. Methods of inspection are therefore used to quality control the manufacturing process.

Critical to the quality of tobacco products with metal susceptors is ensuring that the metal strip is of the correct thickness and correctly placed in the tobacco column without any deformation or twisting.

Figure 2:
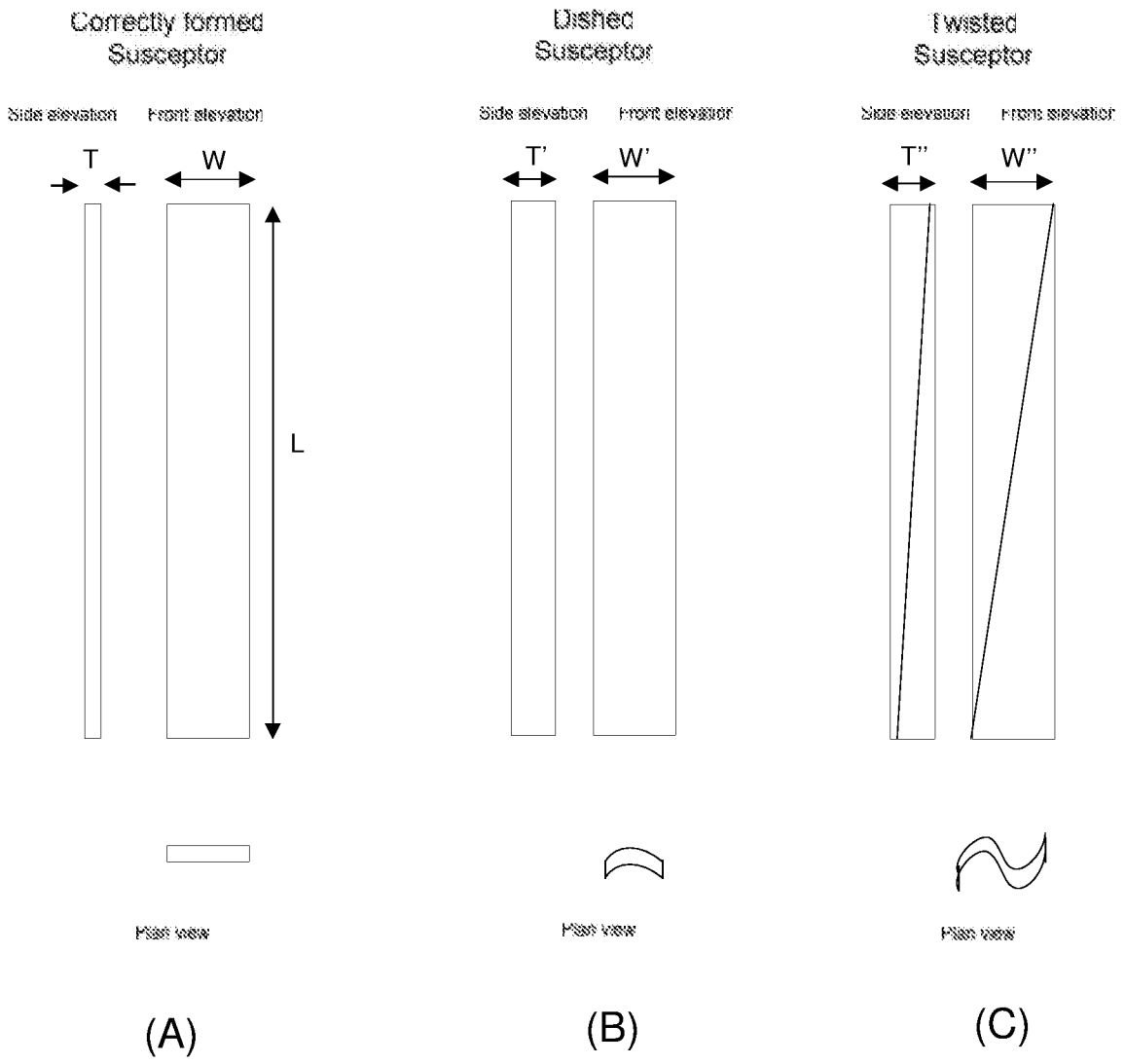

FIGS. 2(A) to 2(C) illustrate some of the different types of deformation that could be caused by the process of cutting and placing of the susceptor in the tobacco stick. It is assumed that a correctly formed susceptor is made from a flat strip of material having a length L, width W and thickness T. A correctly formed susceptor is illustrated in FIG. 2(A). In this case, a side elevation of the susceptor will show the susceptor with a thickness T, and a front elevation of the susceptor will show the susceptor with a width W. A twisted susceptor is illustrated in FIG. 2(B). In this case, a side elevation of the susceptor will show the susceptor with an apparent thickness T', and a front elevation of the susceptor will show the susceptor with an apparent width W'. A dished susceptor is illustrated in FIG. 2(C). In this case, a side elevation of the susceptor will show the susceptor with an apparent thickness T", and a front elevation of the susceptor will show the susceptor with an apparent width W".

Thus, it can be seen that, when the susceptor is deformed, the apparent width and thickness of the susceptor will change. It can further be seen that when observing the susceptor from the side it is not easy to distinguish between a faulty susceptor that is dished or twisted from a susceptor that may not be of the correct thickness. In principle, a plan view of the susceptor may provide some indication of the type of deformation. However, in practice, viewing from the end to determine thickness of the susceptor for deformation runs the potential for misdiagnosis as a twist in the susceptor may not run the whole length of the rod and so may be masked. In addition, in the finished product, the susceptor end may be masked by another element such as a filter material, or be situated beneath the end of the tobacco column, and so not be visible.

One method of determining if the susceptor is deformed or not of correct thickness specification is to view the susceptor from the edge using a penetrative system, such as an x-ray system, as disclosed in WO 2020/012162. This form of x-ray analysis essentially works by the dense metal susceptor casting a "shadow" that is darker than the surround on the detector.

A challenge in such a system is ensuring that the susceptor, which is hidden within the tobacco rod, is aligned correctly to the x-ray source and detector so that an image is formed of the side or face of the susceptor and that this is not at an angle to the source/detector combination. If the detector/source is at an angle to the plane of the susceptor, then the apparent width of the susceptor changes. If this measurement is being used to determine if the susceptor is dished or twisted, then a falsely high projected width result would be reported that might falsely fail an acceptance criterion and/or falsely warn of a processing problem.

Figure 3:
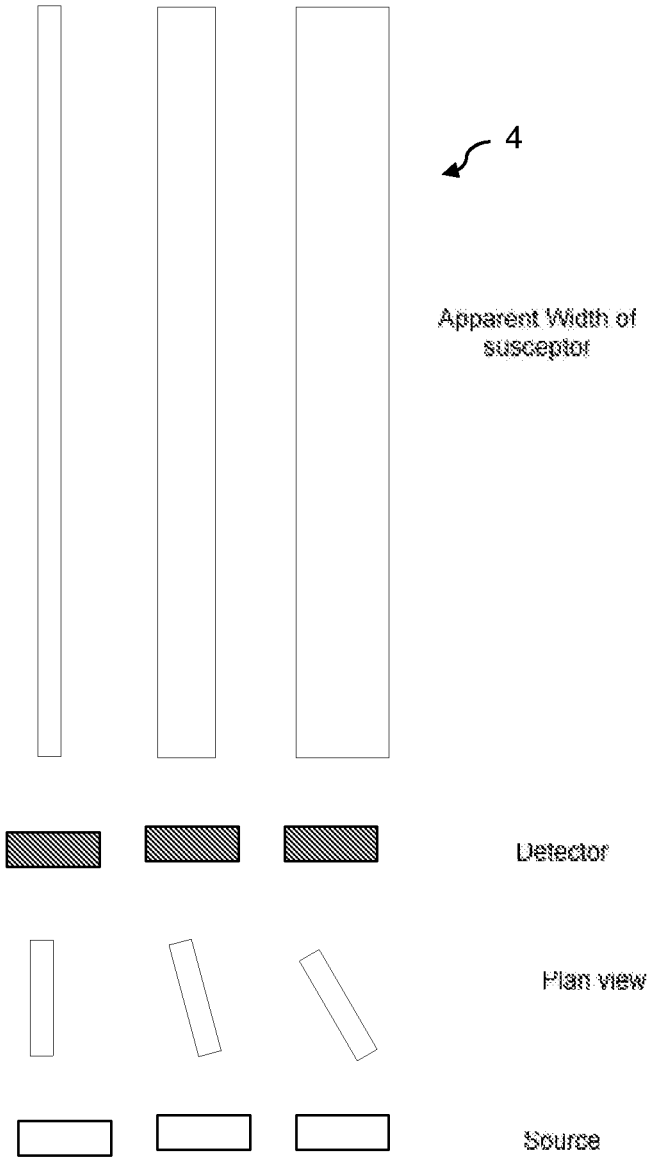
FIG. 3 illustrates a change in apparent width of a susceptor caused by changing the angle between source/detector and sample.
Figure 4:
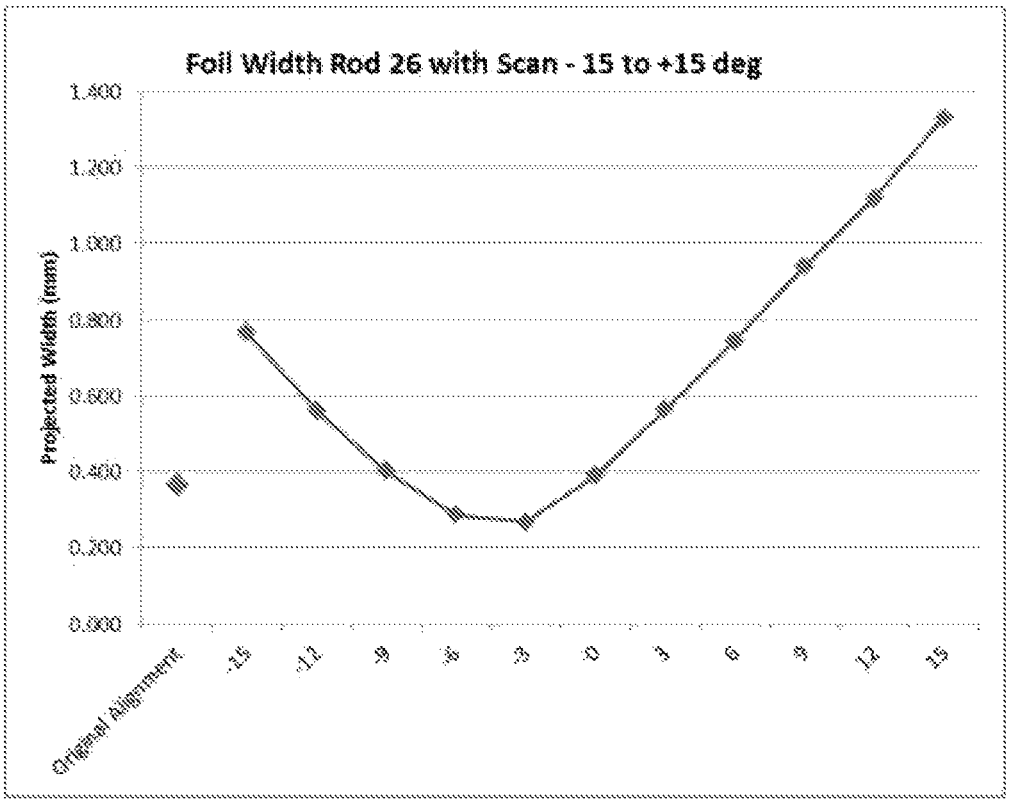
FIG. 4 shows a plot of angle against apparent width.

FIG. 3 illustrates the change in apparent width of the susceptor caused by changing the angle between source/detector and sample. Measuring the apparent width of an ideal susceptor as it rotates yields a plot of angle vs apparent width. An example plot of angle against apparent width is shown in FIG. 4. This principle can be used as a tool for alignment of the sample in a penetrative optical system such as an x-ray system in order to give a true measurement of the size and thickness of the susceptor, the integrity of shape (lack of twisting, bend, dishing etc.) and so forth, and thus allow a set of pass/fail criteria for construction to be assessed.

If the x-ray detection system is fitted with a rotation system, a set of images can be created at different rotational angles and a minimum "width" can be determined for the susceptor. It has been found that an accuracy of rotational angle with respect to the source of 3° or less may be required to produce an image that can be used for determining susceptor width. However, such an approach has the disadvantage of being very time consuming as each image must be taken, collected and analysed. In practice, each image could take up to 10 seconds to form and be processed, and the sample must be rotated between each image. The further the susceptor alignment is from "true" determines the length of time this process takes. Such a time consuming process may be a significant concern if this is a measure of manufacturing control where out of specification products could be made at 10000 per minute or faster.

Another approach would be to "pre-align" the rod using a magnet system. Such a system is disclosed in co-pending UK patent application number GB1917430.9. However, this approach has the disadvantage that the magnetic system requires space to operate and adds cost and complexity to the construction of the x-ray system. Additionally, it will only work with ferromagnetic susceptors and not with alternative materials that may be deployed. Finally, the angular precision of such a rotation technique may not be sufficient for detection and analysis of some potential susceptor defects.

In embodiments of the invention, knowledge of the expected size and shape of the susceptor is used as part of an alignment process to bring the product into a known orientation. This can then allow, for example, side on imaging of the susceptor with an x-ray system.

Figure 5:
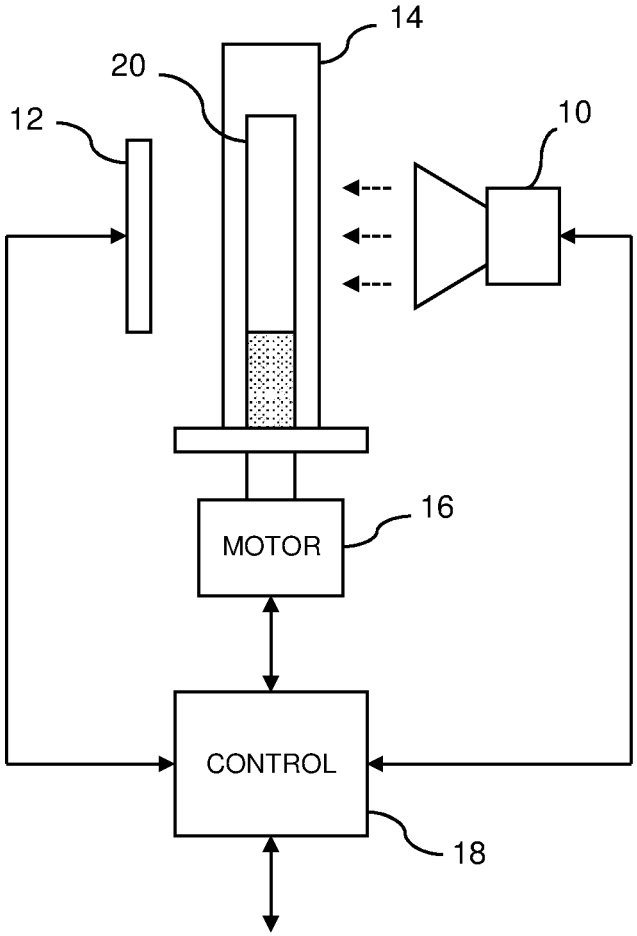
FIG. 5 shows parts of a system for orientating a heated tobacco product in an embodiment of the invention.

FIG. 5 shows parts of a system for orientating a heated tobacco product in an embodiment of the invention. Referring to FIG. 5, the system comprises x-ray source 10, x-ray detector 12, vacuum chuck 14, motor 16 and control unit 18. In operation, the vacuum chuck 14 is used to hold a sample 20 using a vacuum. The x-ray source 10 is used to irradiate the sample 20 with x-rays. The x-rays are detected by the detector 12, which forms an x-ray image of the sample. The motor 16 is used to rotate vacuum chuck 14 such that the sample 20 is rotated about its longitudinal axis. The control unit 18 controls operation of the motor 16, the x-ray source 10 and the detector 12. The control unit may also send and/or receive data and/or commands from other devices.

In operation, the detector 12 is used to take an x-ray image of the sample 20. The thus produced image data are fed from the detector 12 to the control unit 18. The control unit 18 analyses the image data using an image processing algorithm to determine the apparent width of the susceptor in the image of the sample. The control unit then uses the apparent width, together with knowledge of the notional width of the susceptor, to calculate an angle of rotation which would be expected to align the susceptor with the field of view of the imaging system, as will be explained below. Once the angle of rotation has been calculated, the control unit 18 controls the motor 16 to rotate the sample 20 about its longitudinal axis through the calculated angle.

After rotation, a new image of the sample is taken by the detector 12 and fed to the control unit 18. The control unit then determines the apparent width of the susceptor in the new image. This can be used to check that the rotation was successful. If necessary, one or more further rotations may be applied to the sample to align it with the imaging system.

Once the sample has been aligned, further imaging processing algorithms may be used to determine the size and shape of the susceptor, and thus to determine whether the susceptor is within specification. Suitable image processing algorithms for determining the dimensions of an object within an image are known in the art, and therefore not described further.

Figure 6:
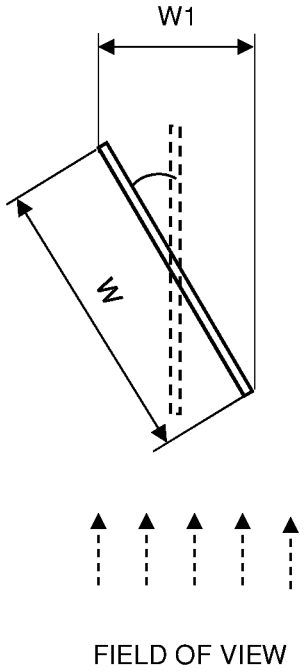
FIG. 6 illustrates how an angle of rotation may be calculated.

FIG. 6 illustrates how the angle of rotation of the sample may be calculated. In FIG. 6, a plan view of the susceptor is shown using solid lines. The susceptor has a notional width W. The notional width W is the expected width of the susceptor, based on the width of the raw material from which the susceptor is formed. The apparent width of the susceptor, as seen by the detector, is W1. The angle θ is the angle through which the susceptor needs to be rotated in order for it to be aligned with the field of view of the detector. The position of the susceptor when aligned with the detector is shown by the dashed lines. It is assumed that the susceptor has a thickness T which is much less than its width.

From FIG. 6, it can be seen that, to a first approximation:

$$\cos\theta = \frac{W1/2}{W/2} \tag{1}$$

Therefore, the value of θ can be calculated from:

$$\theta = \cos^{-1}\frac{W1}{W} \tag{2}$$

Thus, the apparent width of the susceptor, together with knowledge of its expected or notional width, can be used to calculate the magnitude of the angle of rotation which would be expected to align the susceptor with the field of view of the x-ray system, using equation (2) above.

However, it can be seen from FIG. 6 that the susceptor has rotational symmetry. Thus, the same apparent width would be produced if the susceptor were orientated either clockwise or anticlockwise by the same amount. Thus, the alignment process needs to take into account the fact that the rotation may need to be either clockwise or anticlockwise. This may be done by first rotating the sample in one direction through the angle θ, then taking a new image of the sample and checking that the apparent width has in fact reduced. If the rotation did not reduce the apparent width (indicating that the original direction of rotation was incorrect) then the sample is rotated in the opposite direction through an angle of 20.

Figure 7:
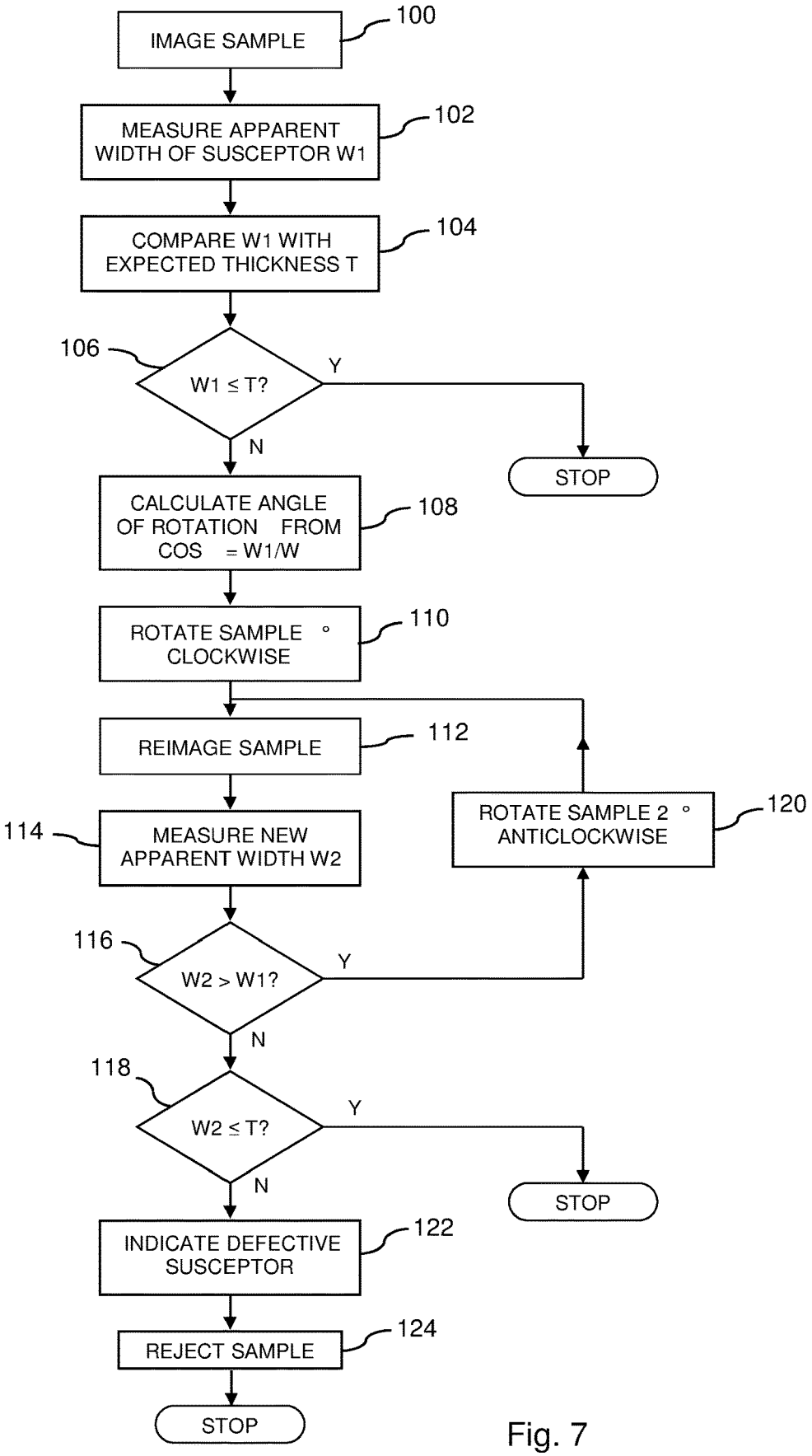
FIG. 7 shows steps taken by the orientation system in one embodiment.

FIG. 7 shows steps taken by the orientation system in order to align the susceptor with the x-ray imaging system in one embodiment. Referring to FIG. 7, in step 100 an image is taken of the sample. In step 102, the apparent width W1 of the susceptor in the image of the sample is measured. In step 104, the apparent width W1 is compared to the expected thickness T. In step 106, it is determined whether the apparent width W1 is less than or equal to the expected or notional thickness T (within the required margin of error). If this is the case, then it is assumed that the susceptor is already aligned with the imaging system, and the alignment process stops. If on the other hand the apparent width W1 is greater than the expected thickness T, then in step 108 the angle of rotation θ is calculated using equation (2) above, where W is the expected or notional width of the susceptor. In step 110 the sample is rotated in one direction (in this case, clockwise) through the angle θ.

In step 112 an image of the sample in the new position is taken. In step 114, the apparent width W2 of the susceptor in the new image is measured. In step 116 it is determined whether the value of W2 is greater than that of W1. If W2 (the apparent width of the susceptor in the second image) is greater than the value of W1 (the apparent width in the first image) then it is assumed that the sample has been rotated in the wrong direction. In this case, in step 120, the sample is rotated through an angle of twice θ in the opposite direction (here, anticlockwise). This is done in order to correct for the original (incorrect) rotation and to rotate the sample to a position where the susceptor is assumed to be aligned with the field of view. The image is then resampled (step 112), and the new apparent width measured (step 114). Since the new apparent width should be less than the previous apparent width (step 116), processing would then normally proceed to step 118. However, if desired, a limit could be placed on the number of times that the sample is rotated.

If on the other hand the value of W2 is not greater than that of W1, then it is assumed that the original rotation was in the correct direction. in this case, in step 118, it is determined whether the apparent width W2 is less than or equal to the expected or notional thickness T (within the required margin of error). If W2 is less than or equal to T, then it is assumed that the susceptor is aligned, and the alignment process stops.

If on the other hand the apparent width W2 is greater than the expected thickness T, then it is likely that the susceptor is twisted, bent or otherwise outside of specifications. In this case, in step 122, it is indicated that the susceptor is defective. This may be done, for example, by generating an alarm signal, or sending a fault signal to another piece of equipment. In step 124 the sample is rejected, and the process then stops.

In the arrangement described above, the calculation of the rotation angle assumes that the value of W is large in comparison to that of T. In the case of a foil susceptor this is a reasonable assumption. In general, the above calculations may be used where the value of W is sufficiently large in comparison to that of T to give the required level of accuracy, for example, a maximum error of 3° or less.

However, alternative susceptor geometries may require the value of T to be taken into account when calculating the angle of rotation θ. This may be done using the appropriate trigonometric calculations.

Furthermore, additional steps could be added to provide more precise susceptor width measurements and greater detail concerning the structure/defects in the susceptor. Confirmation of the width of the susceptor can be obtained by a 900 rotation and calculation that can be re-used to "tune" the susceptor edge alignment, if necessary.

If desired, different values of the angle of rotation could be calculated, in order to rotate the sample so that the susceptor is at a different angle to the field of view, such as perpendicular or at 45°. For example, the angle of rotation which would be expected to bring the susceptor perpendicular to the field of view can be calculated from:

$$\theta = \sin^{-1}\frac{W1}{W} \tag{3}$$

In this case, the appropriate adjustments would be made to the alignment process described above, in order to rotate the sample so that the susceptor is perpendicular to the field of view.

As an alternative to calculating the angle of rotation, a look up table could be used which maps apparent width W1 to angle of rotation θ using predetermined values.

Once the alignment process has been performed, an image of the sample can be taken with the susceptor in side elevation. Once the side image is obtained, the thickness or deformation of the susceptor can be obtained using known image analysis techniques and tools.

For example, in one implementation a "best fit" box can be drawn about the susceptor to yield a minimum side dimension. This numerical analysis can be compared against pass/fail criteria within the equipment and an indication given for the quality of the susceptor formation and ultimately the acceptability of the heated tobacco product.

Figure 8:
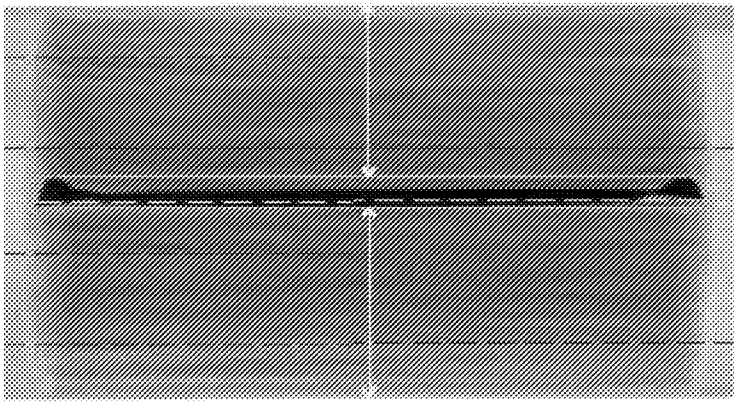
FIG. 8 shows an example of an x-ray image of a sample with the susceptor aligned with the imaging system.

FIG. 8 shows an example of an x-ray image of a sample with the susceptor aligned with the imaging system. In FIG. 8, the susceptor can be seen at the centre of the image, inside the tobacco column. Image processing software has been used to draw a "best fit" box around the susceptor. From this, various dimensions can be obtained, such as the thickness of the susceptor and distance from the edge of the tobacco column in each direction. These measurements can be used as part of a quality control process. Similar techniques can also be used to determine the apparent width of the susceptor.

In the arrangement described above, the system consists essentially of five elements, namely, a source of x-ray illumination, a means of detecting the x-rays in the form of an image, a means of holding the sample under test, a means of rotating the sample under test, and a means for controlling the process and performing the necessary calculations.

In a preferred embodiment, the x-ray source is selected and configured so that it illuminates a region of interest of a section of the sample under test immediately in front of the detector system. The energy of the x-rays used is selected so that they have sufficient penetrative capabilities for the test and so that they are suitable for the detection means. It is usually desirable to use lower energy x-rays as these have lower penetrative power so shielding requirements for the safety of operators is substantially reduced. However, these so called "soft" x-rays cannot be of too low energy as they may not penetrate the sample or may not be detected at the detector area. A compromise needs to be reached based on practical considerations.

The type of source—collimated or broad beam—is again selected depending on the detector system selected.

As an alternative, use of oblique illumination or backscattering or other forms of electromagnetic radiation instead of x-rays would also be a possibility, although in practice may be less effective.

The detector could be a device such as a large area detection plate. Such a device can image an area of the sample under test in a single exposure. This has some disadvantages concerning the type of source and energy of that source as well as a high cost of the detector, the cost being proportional to the size of the illumination area to be analysed.

An alternative detector could be an area image sensor based on CMOS/CCD technology as described in WO 2020/012162. In such a system, a small strip or panel detector is situated in line with a low power collimated x-ray source. The sample under test is held and moved through the x-ray beam and a high-quality image produced a line (or a few lines) of pixels at a time over the whole length of the sample. Such an arrangement may be preferred due to its relative low cost and simplicity.

The third element is a device for holding the sample under test. This device must also fulfil a number of different requirements. Firstly, the holding mechanism must hold the sample firmly as any slippage during initial imaging or during rotation would invalidate the measurements and compensation for the angle of presentation of the susceptor. On the other hand, the holding mechanism should not obscure the region of interest. In some embodiments, only part of the sample may be imaged at any one time. In this case, a portion of the sample for testing can be held. Care must also be taken not to damage or distort the sample.

The holding mechanism could take the form of grippers, an expandable sleeve or latex or other flexible medium or an expanding iris. However, in a preferred embodiment, the holding mechanism takes the form of a foot on which the sample sits and a vacuum that holds the sample against a surface that is largely transparent to x-rays. This approach has the merit that the whole sample can be imaged without any losses and the holding can be sufficiently firm to meet the requirements of the system.

Once held the rod under test needs to be rotated. The rotational mechanism should either be free of backlash or there needs to be compensation mechanisms to eliminate any backlash in the system. This can take the form of mechanical devices that "load" movements that remove backlash, procedures that remove the impact of backlash such as always approaching from a single direction in rotating or software.

Rotational systems could employ rack and pinion type movements, simple driven gears, belt drives, timing belts and so on. In most cases the fundamental is a motor and a geared drive system.

The rotation needs to be absolute in that the angle of rotation is calculated from the initial image and so has to be rotated to compensate. The amount of rotation can be judged using a stepper motor configuration and counting the steps travelled, the degree of travel being a function of the number of steps per rotation of the motor and any gearbox configuration. Alternatively, the rotational mechanism or shaft can be fitted with an encoder that reads back the angular position of the sample. In this way the correct amount of rotation is applied, and this is particularly effective in a system where mechanical backlash has been eliminated.

It is important that there is no lateral movement during the rotation. For practical purposes the means of holding the sample steady in front of the source and detector may need to be released. It is also feasible to remove the sample from the source/detector field of view, rotate and return it, provided that the relationship between source and sample is maintained and understood.

Figure 9:
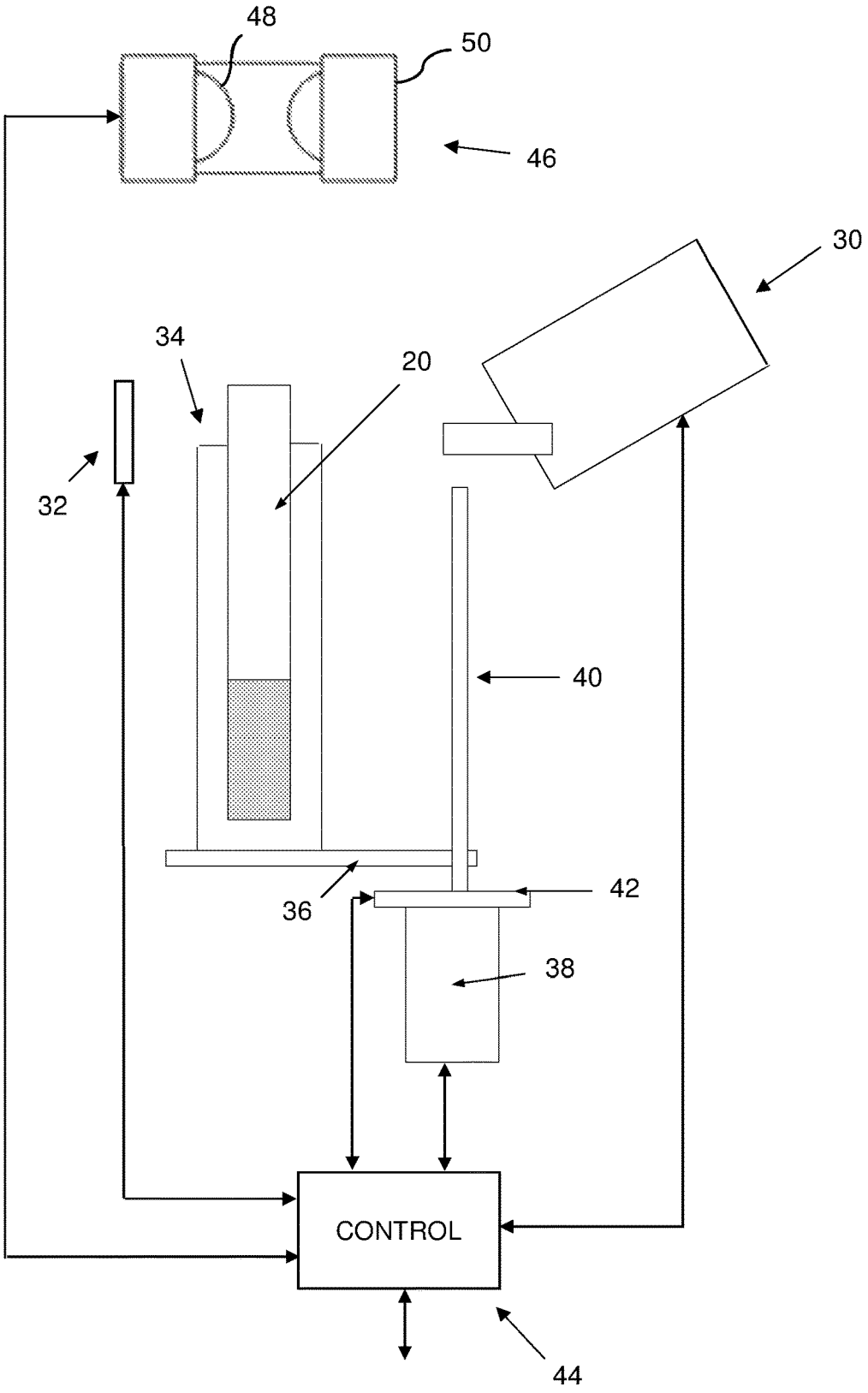
FIG. 9 shows parts of a system for analysing a heated tobacco product in another embodiment.

FIG. 9 shows parts of a system for analysing a heated tobacco product in another embodiment. The system comprises x-ray source 30, x-ray panel detector 32, vacuum chuck 34, platform 36, drive motor 38, leadscrew 40, positional encoder 42, control unit 44 and rotating chuck 46. The x-ray source 30, x-ray panel detector 32, vacuum chuck 34, drive motor 38, and control unit 44 may the same as or similar to the x-ray source 10, x-ray panel detector 12, vacuum chuck 14, drive motor 16, and control unit 18 described above with reference to FIG. 5. Referring to FIG. 9, the vacuum chuck 34 is used to hold a sample 20 using a vacuum. The vacuum chuck 34 is attached to the platform 36, which is translated by means of the drive motor 38 and leadscrew 40. The leadscrew 40 is aligned with the axis of the sample 20, such that rotation of the motor 38 causes the sample to move axially with respect to the source 30 and the detector 32. The control unit 44 is used to control the operation of the motor 38 in order to move the sample 20 into the appropriate position for imaging. The exact positional reference to the vacuum chuck is measured by the positional encoder 42 and sent to the control unit 44.

In operation, the sample 20 is first moved to a position in which an area of interest is in the field of view of the detector 32. Images of the sample are then taken by the panel detector 32 and transferred to the control unit 44. The sample is then moved axially to another position. In this position additional images are taken and transferred to the control unit 44. This process may be repeated for a number of different positions of the sample. Preferably, the sample is moved such that images are taken along its entire length, with each image abutting or overlapping with the next. If desired, certain parts of the sample may be imaged as the sample is moving and/or with a reduced exposure time compared to other parts. The control unit 44 includes a suitable imaging algorithm for producing a composite image based on the individual images of different areas of the sample taken by the panel detector 32. The thus produced image data may be analysed to determine the dimensions of the susceptor in the sample in the ways described above.

In this embodiment the source 30 is a collimated low energy x-ray source. The detector 32 is a flat panel detector which may be, for example, of the CMOS (complementary metal-oxide-semiconductor) or CCD (charge-coupled device) type. Alternatively, a line detector could be used instead of the panel detector. The x-ray system may be, for example, as described in International patent application number WO 2020/012162, although other types of x-ray imaging systems could be used instead.

In the arrangement of FIG. 9, the sample is rotated outside of the analysis area by the rotating chuck 46. The rotating chuck 46 includes a gripping mechanism 48 and a rotating mechanism 50. The gripping mechanism 48 comprises an expanding latex sleeve which is arranged to grip the sample sufficiently firmly to hold it in place, without damaging it. The rotating mechanism 50 includes a motor which allows the gripping mechanism to be rotated in a controlled manner. The rotating chuck 46 operates under control of the control unit 44.

In operation, the sample 20 is first held by the gripping mechanism 48 in the rotating chuck 46. The gripping mechanism then releases the sample so that it drops onto the platform 36. Once on the platform, the sample is held in place by the vacuum chuck 34. The sample 20 is then lowered through the beam of x-rays and a first image built up by the detector 32 and control unit 44.

Once the first image of the sample 20 has been produced, the sample is raised so that it is outside the analysis area. The top of the sample is then gripped by the gripping mechanism 48 without rotating or translating it. The sample is released by the vacuum chuck 34 and then rotated by the rotating chuck 46, the angle of rotation being calculated in any of the ways described above. The holding of the sample by vacuum on the platform 36 is then resumed and the rotating chuck releases the sample. The sample is then brought again through the source and detector to create the second image. This can be repeated several times. Once the sample is correctly aligned, measurements can be made as part of a quality control process. Once measurements are complete the platform 36 is removed, and the vacuum released which drops the no longer needed sample into a collection bin.

FIGS. 10(A) to 10(D) illustrate the process of imaging and rotating the sample in one embodiment. Referring to FIG. 10(A), the sample 20 is first dropped onto the platform 36 and held in place by the vacuum chuck 34 outside the field of view of the detector 32 and source 30. The platform is lowered, and a first image is captured for the whole of the sample. Referring to FIG. 10(B), the sample is out of field of view of the source/detector. The direction of travel is reversed and the sample is raised until it enters the rotating chuck 46. Referring to FIG. 10(C), the sample is gripped by the gripping mechanism 48 which comprises a set of latex fingers or sleeves that hold the sample firmly yet gently. The holding vacuum is released and the platform 36 is moved away from the sample. The rotating chuck 46 is then rotated through the correct angle to compensate for the angle the susceptor is toward the plane of the detector. The platform 36 is then raised, the holding vacuum reapplied and then the rotating chuck 46 is released.

Referring to FIG. 10(D), the sample held firmly on the platform 36 is lowered and the source/detector takes a second image as described above.

FIG. 11 shows steps taken by the orientation system in another embodiment. In FIG. 11, steps 100 to 116 are the same as or similar to the corresponding steps described above with reference to FIG. 7, and therefore are not described further.

In the arrangement of FIG. 11, if it is determined in step 116 that the value of W2 is greater than that of W1, then processing passes to step 130. In step 130, a new angle of rotation $\theta_2$ is calculated from $$\theta_2 = \cos^{-1}\frac{W2}{W} \tag{4}$$

where W2 is the apparent width of the susceptor in the second image and W is the expected or notional width of the susceptor. Then, in step 132 the sample is rotated anticlockwise through the angle $\theta_2$. This corrects for the original (incorrect) rotation and rotates the sample to a position where the susceptor is assumed to be aligned with the field of view. The image is then resampled in step 134 and a new version of the apparent width W2 is measured in step 136. In step 118 it is determined whether the apparent width W2 is less than or equal to the expected or notional thickness T (within the required margin of error). If W2 is less than or equal to T, then it is assumed that the susceptor is aligned, and the alignment process stops.

If on the other hand the apparent width W2 is greater than the expected thickness T, then it is likely that the susceptor is twisted, bent or otherwise outside of specifications. In this case, in step 122, it is indicated that the susceptor is defective, and in step 124 the sample is rejected.

An advantage of the arrangement shown in FIG. 11 is that it may be possible to measure larger values of the apparent width with greater accuracy than smaller values. Therefore, by recalculating the angle of rotation in step 130, it may be possible to align the susceptor with a greater degree of accuracy.

In an alternative arrangement, an average of the values $2\theta_1$ and $\theta_2$ could be calculated, and the sample rotated anticlockwise through the average of the two.

In either of the embodiments shown in FIGS. 7 and 11, before indicating a defective susceptor in step 122 and rejecting the sample in step 124, further attempts to align the sample could be made. For example, a number of incremental rotations could be performed and, after each rotation, a new image taken and the apparent width compared to the notional thickness T. An analysis of the apparent widths in the previous attempts may indicate the direction in which rotation should take place. This process could be continued until the apparent width is less than or equal to the notional thickness T (within the required margin of error), or until the apparent width starts to increase, or until a predetermined number of attempts have been made. This may help to compensate for any inaccuracies in the preceding steps.

In any of the above embodiments, the means for controlling the process and performing the necessary calculations (such as the control unit 18, 44) may be implemented as a processor and associated memory running the appropriate software, in order to carry out the functions described above.

Thus, it will be appreciated that embodiments of the invention relate to a method for aligning a susceptor or metal element within a rod-shaped article with respect to an imaging system such as an x-ray system. An initial through-rod image, that may be out of alignment with the source/detector, together with the nominal dimensions of the susceptor or metal element can be used to calculate the angle of the susceptor or metal element with respect to the source and detector of the imaging system. The imaging system is equipped with a means of rotation that can be applied to the sample under test. The rotation system rotates the sample under test by the calculated angle of the susceptor or metal element to the source detector of the imaging system so that a second image can be obtained where the susceptor is now orthogonal (edge on) to the source/detector. After rotation, if the apparent width of the susceptor has increased, the sample under test is rotated in the opposite sense to the first rotation by twice the rotation angle calculated. The rotation mechanism may be equipped with an absolute angular encoder to determine rotational angle. Backlash in the rotation system may be compensated for mechanically or by adjusting arithmetically the angle of sample rotation. As an alternative, the source and detector may be rotated with respect to the sample under test. The sample may be rotated 90° and imaged to determine the true width of the susceptor. This determination may be used to provide fine compensation for the edge on image rotation. The edge-on image of the susceptor may be used to determine the thickness of the susceptor. The edge on image of the susceptor may be used to determine if any twisting, dishing or other distortion of the susceptor form has taken place. The imaging source may be an x-ray source. The imaging source and rotational apparatus may be controlled by electronics and a microprocessor. The susceptor analysis may be used as part of a quality screen process testing against pass and fail criteria.

It will be appreciated that embodiments of the invention have been described above by way of example only, and variations in detail are possible. For example, features of one embodiment may be used with any other embodiment. Although the invention has been described for use with a heated tobacco product with an internal susceptor, other types of tobacco product could be used instead. The exact construction of the product may vary, and is described above for illustrative purposes only. The invention may also be used with other types of smoking products which contain strip components other than a susceptor. Other variations in detail will be apparent to the skilled person.

The invention claimed is:

1. Apparatus for orientating a tobacco product containing a strip component, the apparatus comprising:

an imaging system arranged to produce an image of the tobacco product;

a processor arranged to:

determine an apparent width of the strip component from the image, and determine an amount of rotation based on the apparent width; and a rotating mechanism arranged to rotate the tobacco product relative to the imaging system by the determined amount of rotation.

2. Apparatus according to claim 1, wherein the strip component is a susceptor.

3. Apparatus according to claim 1, wherein the amount of rotation is an amount which is expected to bring the strip component into a known orientation with respect to a field of view of the imaging system.

4. Apparatus according to claim 1, wherein the amount of rotation is that which is expected to align the strip component with or bring the strip component perpendicular to a field of view of the imaging system.

5. Apparatus according to claim 1, wherein the amount of rotation is calculated from the apparent width and a notional width of the strip component.

6. Apparatus according to claim 5, wherein the notional width is a predetermined value.

7. Apparatus according to claim 5, wherein the amount of rotation is calculated from the apparent width and the notional width using an inverse trigonometric function.

8. Apparatus according to claim 5, wherein the amount of rotation is calculated from the equation $$\theta = \cos^{-1}\frac{W1}{W}$$

where θ is the amount of rotation, W1 is the apparent width and W is the notional width.

9. Apparatus according to claim 1, wherein the imaging system is arranged to produce a second image of the tobacco product after the tobacco product has been rotated, and the processor is arranged to determine a second apparent width of the strip component from the second image.

10. Apparatus according to claim 9, wherein the apparatus is arranged to compare the second apparent width to the apparent width, and to rotate the tobacco product in an opposite direction to that in which the tobacco product was originally rotated in dependence on a result of the comparison.

11. Apparatus according to claim 10, wherein the apparatus is arranged to rotate the tobacco product in the opposite direction when the result of the comparison indicates that the apparent width has changed in a way which is opposite to that which is expected when the original rotation had been in a correct direction.

12. Apparatus according to claim 9, wherein the apparatus is arranged to determine whether the second apparent width is greater than the apparent width, and to rotate the tobacco product in an opposite direction to that in which the tobacco product was originally rotated when the second apparent width is greater than the apparent width.

13. Apparatus according to claim 1, wherein the processor is arranged to compare the apparent width with a notional dimension of the strip component, and the rotating mechanism is arranged to perform the rotation in dependence on a result of the comparison.

14. Apparatus according to claim 13, wherein the orientation process is terminated when the apparent width has a predetermined relationship with the notional dimension.

15. Apparatus according to claim 13, wherein the notional dimension is one of notional thickness or notional width.

16. Apparatus according to claim 1, wherein the apparatus is arranged such that, after having rotated the tobacco product, the tobacco product is then rotated through 90° and a further image taken.

17. Apparatus according to claim 16, wherein the apparent width of the strip component in the further image is determined, and the thus determined width is used in a subsequent calculation of the amount of rotation.

18. Apparatus according to claim 1, wherein the imaging system is arranged to produce an x-ray image of the tobacco product.

19. A testing apparatus for testing a tobacco product containing a strip component, the testing apparatus comprising:

an imaging system arranged to produce and image of the tobacco product;

a processor arranged to:

determine an apparent width of the strop component from the image, and determine an amount of rotation based on the apparent width; and a rotating mechanism arranged to rotate the tobacco product relative to the imaging system by the determined amount of rotation, wherein the testing apparatus is arranged to produce a second image of the tobacco product after rotation of the tobacco product, and to analyse the second image to detect a defect in the strip component.

20. A method of orientating a tobacco product containing a strip component, the method comprising:

producing an image of the tobacco product with an imaging system;

determining an apparent width of the strip component from the image;

determining an amount of rotation based on the apparent width; and rotating the tobacco product relative to the imaging system by the determined amount of rotation.

* * * * *